United States Patent [19]

Felker et al.

[11] 4,061,276

[45] Dec. 6, 1977

[54] FRACTIONING AUTOGENOUS TRITURATOR

[76] Inventors: Paul J. Felker, 2200 Washington Ave.; Shubel H. Owen, Rte. 4, Box 238, both of Marshfield, Wis. 54449

[21] Appl. No.: 759,964

[22] Filed: Jan. 17, 1977

[51] Int. Cl.[2] ..... B02C 23/10

[52] U.S. Cl. ..... 241/69; 241/284

[58] Field of Search ..... 241/39, 69, 277, 284; 259/3

[56] References Cited

U.S. PATENT DOCUMENTS

| | | | |
|---|---|---|---|
| 251,535 | 12/1881 | Duc, Jr. | 241/284 |
| 288,724 | 11/1883 | Newsom | 241/284 |
| 1,293,656 | 2/1919 | Adams | 241/69 |
| 3,326,476 | 6/1967 | Izguierdo | 241/284 |

*Primary Examiner*—Granville Y. Custer, Jr.

*Attorney, Agent, or Firm*—Wheeler, Morsell, House & Fuller

[57] ABSTRACT

An autogenous triturator mill for reducing particle size by colliding streams of particles in the center of a rotating bowl includes a bowl with radial vanes which is supported on a frame for rotation by a motor. Deflectors on the frame and located within the bowl intercept material centrifugally elevated in the bowl and direct the material inwardly in the form of a plurality of intersecting streams. Collision of particles in the intersecting streams reduces particle size. The concave sides of the bowl are provided with screens or foraminous walls to enable escape of fines of a pre-selected particle size from the bowl. The fines are fractioned off through the foraminous outlet as the particle size is reduced by repeated trituration or collision of the recirculating particles.

6 Claims, 2 Drawing Figures

FRACTIONING AUTOGENOUS TRITURATOR

BACKGROUND OF THE INVENTION

This invention relates to material processing apparatus in which material particles are reduced in size by collisions of streams of particles. This invention is a further development of the subject matter of our application Ser. No. 720,189.

SUMMARY OF INVENTION

The invention provides a fractioning autogenous triturator which continuously reduces the particle size of materials introduced into an accelerating bowl by repeated collisions of recirculating particles in intersecting streams. A foraminous outlet wall in the bowl enables the continuous escape of fines from the bowl as the particles are reduced to a pre-selected size. The apparatus includes a bowl or container which is rotatably supported by a bearing on a frame for rotation by a motor and belt drive. The bowl has an upwardly concave wall portion with vanes adjacent the bowl bottom to accelerate the contents of the bowl and cause the particles to move upwardly along the curved bowl surface by centrifugal force. The centrifugally elevated particles are intercepted by deflectors which are fixed to the frame and supported within the upper bowl wall. The deflectors cause the particles to form a plurality of streams which intersect centrally of the bowl. The fines are continuously fractioned off through the foraminous outlet as the particles are reduced in particle diameter. The foraminous outlet can be in the form of a screen with the screen mesh selected for the particle size desired.

Further objects, advantages and features of the invention will be apparent from the disclosure hereof.

DESCRIPTION OF PREFERRED EMBODIMENT

Figure 1:
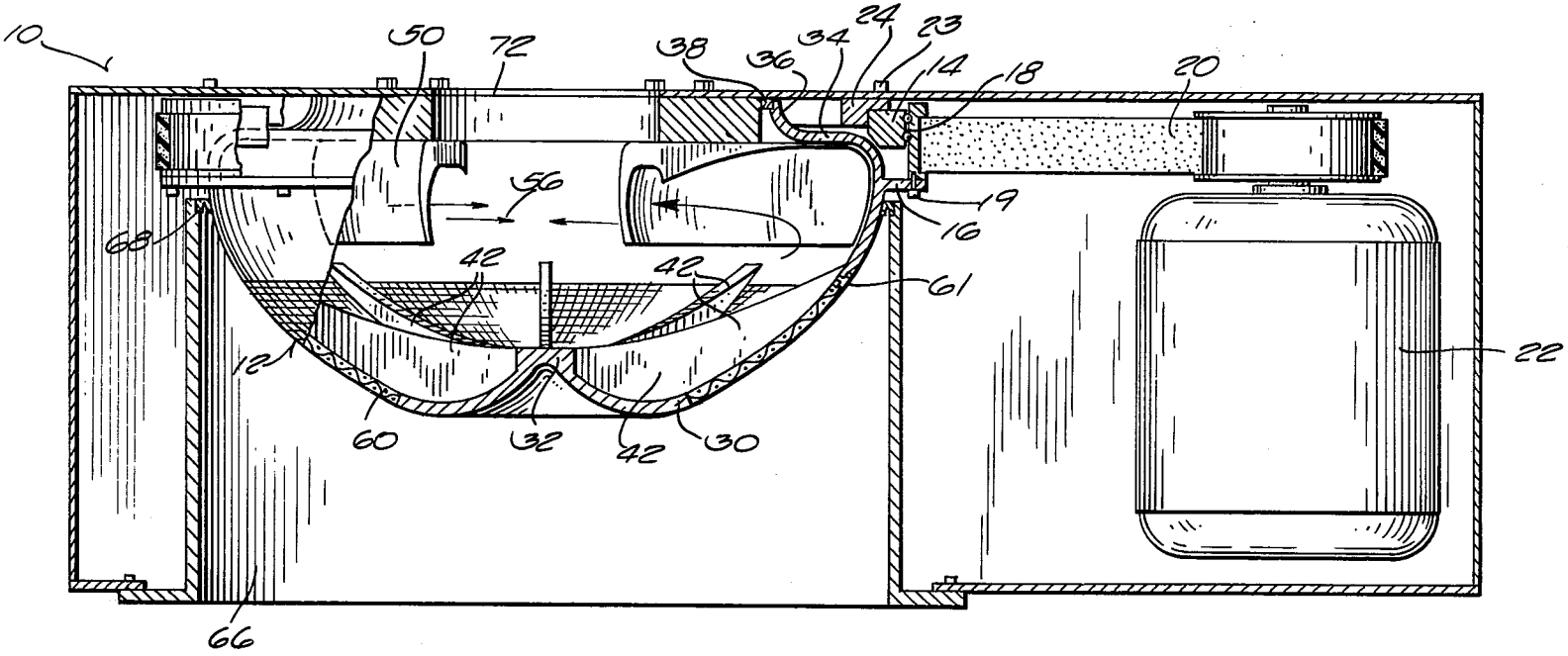
FIG. 1 is a side elevational view in fragmentary section of apparatus in accordance with the invention.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The apparatus includes a frame 10, a bowl 12, and a bearing ring 14 for rotatably supporting the bowl 12 on the frame. The bowl 12 has a laterally outwardly extending flange 16 which is connected to a ring 18 by screws 19. The ring 18 functions as a pulley or a sheave surface which receives a drive belt 20 driven by a motor 22. The bearing 14 is connected to the frame 10 by screws 23.

The bowl 12 has an upwardly concave wall portion 30 which extends from a central boss or hub 32. The wall portion 30 merges with an inturned wall portion 34 which has an upturned lip 36 which engages a material seal 38 on the frame 12 to prevent exit of materials being processed. The bowl is provided with radially extending vanes 42 which radiate from the hub 32 and also curve upwardly along the bowl wall portion 30.

Figure 2:
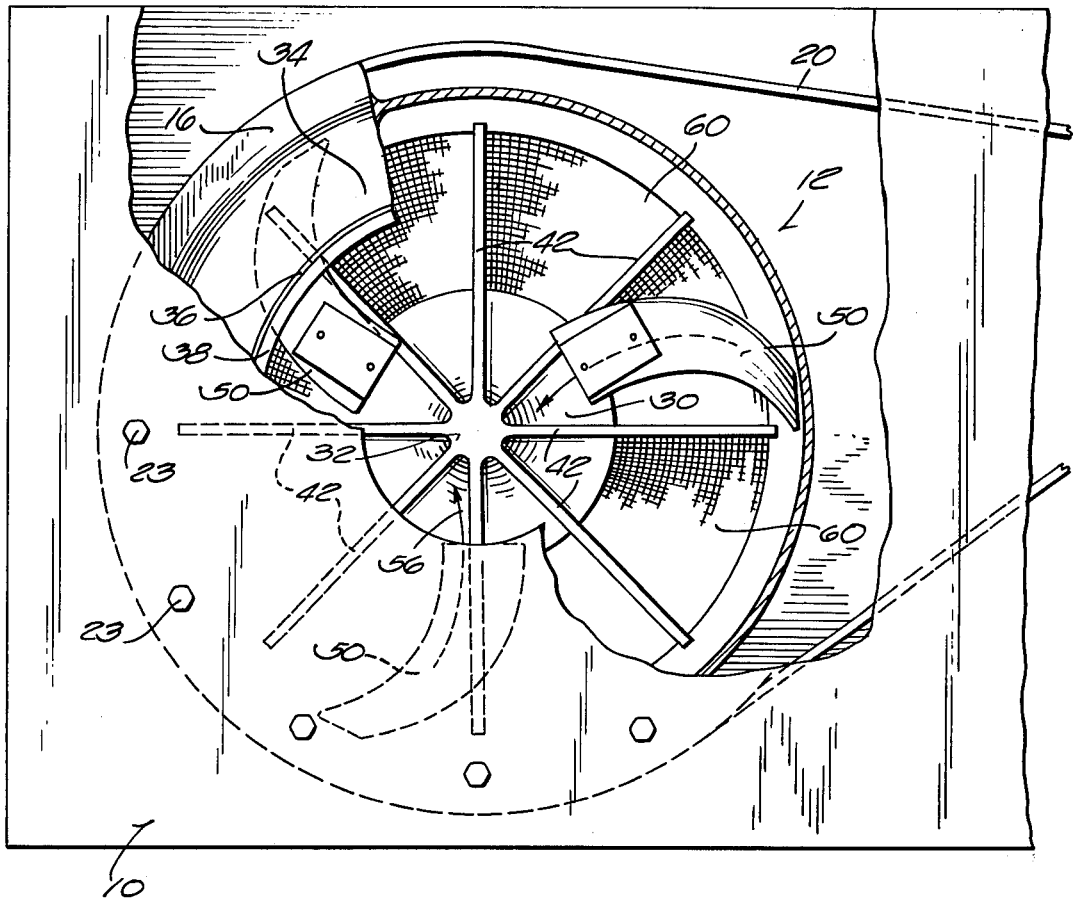
FIG. 2 is a fragmentary plan view of the apparatus disclosed in FIG. 1.

The frame 12 is provided with a plurality of material deflectors 50 which have an arcuate shape (FIG. 2) to intercept centrifugally elevated particles on the concave wall 30 and direct and guide the particles inwardly in the form of particle streams 56 (FIG. 2) which cause collision and trituration of the particles centrally of the bowl.

In accordance with the invention, the bowl is provided with foraminous outlet means 60 which in the disclosed construction is in the form of a screen ring concentric to the bowl hub 32. The screen ring is shaped to the bowl contour. The screen mesh is selected to fraction off the desired particle size. The screens 60 can be detachably secured by bolts 61 to the bowl to facilitate changing screens. Perforated plates can also be employed. The particles continuously fraction off during operation of the apparatus as they are reduced to the selected particle size by continuous circulation and collision as presently described. Inasmuch as the foraminous walls 60 are located slightly upwardly of the bottom of the bowl, centrifugal forces will tend to urge the particles through the screen.

The apparatus includes a cylindrical discharge receiver or outlet 66 which surrounds the bowl and collects the discharge from the foraminous outlet 60. A material seal 68 can be employed to prevent loss of material between the receiver 66 and frame 12.

In operation, as the material rotates with the bowl and climbs the bowl walls, it encounters the material deflectors 50 which re-direct the flow of material in the form of the streams 56 which intersect near the bowl center axis above the hub 32 at near the velocity of material at the bowl's maximum circumference. The intersecting streams of material collide and triturate autogenously. After collision, the velocity of the material is reduced and the materials fall to the bottom of the bowl by gravity and the cycle is repeated. With each successive cycle of acceleration and collision a part of the fine fraction of material exists through the screen 60 and the remainder of the material is recirculated and triturated to become fines. The process continues as long as fresh material is added to the machine in sufficient quantities to provide adequate material flow for trituration. The material to be processed is introduced through the frame opening 72.

What is claimed is:

1. Material processing apparatus comprising a bowl having a bottom wall and an upwardly concave wall portion terminating in a bowl rim, a frame, means for rotatably supporting the bowl on said frame for rotation about a vertical axis, means in said bowl to impart rotational movement to materials contained in the bowl for travel upwardly along the concave wall, an inlet in said frame above said bowl bottom wall for introducing materials to be processed into said bowl, a plurality of deflector means located on said frame and within said bowl for intercepting material centrifugally elevated toward said bowl rim on said concave wall portion and for directing the materials in a plurality of guided and intersecting material streams to cause collision of the materials in the streams to triturate the particles, and foraminous outlet means in said bowl having openings sized to afford escape of fines of a pre-selected particle size as particles are reduced to said size during recirculation and repeated trituration.

2. Material processing apparatus in accordance with claim 1 wherein said foraminous outlet means are on said concave wall surface spaced from the bowl rotational axis to enable centrifugal force to urge particles through the foraminous outlet.

3. Apparatus in accordance with claim 1 including a particle receiver having wall portions extending above said foraminous outlet to receive particles exiting from said foraminous outlet.

4. Material processing apparatus in accordance with claim 1 wherein said foraminous outlet means comprise screens having a shape complementary to the shape of contiguous bowl wall portions.

5. Apparatus in accordance with claim 3 including a material seal between said receiver and said bowl above said foraminous outlet.

6. Apparatus in accordance with claim 1 wherein said bowl has an upturned lip and a material seal between said lip and said frame.

* * * * *